US005835002A

United States Patent [19]

Barnett

[11] Patent Number: 5,835,002

[45] Date of Patent: Nov. 10, 1998

[54] INTERLOCK ASSEMBLY FOR A MANUALLY OPERATED MULTI-PHASE FUSIBLE SWITCH

[75] Inventor: Richard N. Barnett, Rockvale, Tenn.

[73] Assignee: Square D Company, Palatine, Ill.

[21] Appl. No.: 845,305

[22] Filed: Apr. 25, 1997

[51] Int. Cl.[6] ..... H01H 71/20; H01H 71/10; H01H 71/12

[52] U.S. Cl. ..... 337/143; 337/6; 337/174; 337/241; 337/210

[58] Field of Search ..... 337/9–8, 142–147, 337/156, 174, 210, 214, 225, 241–245, 226; 361/1, 103, 104

[56] References Cited

U.S. PATENT DOCUMENTS

| | | | |
|---|---|---|---|
| 3,777,084 | 12/1973 | Rys | 200/50 A |
| 3,842,380 | 10/1974 | Granson et al. | 337/6 |
| 3,909,762 | 9/1975 | Wilks et al. | 337/4 |
| 5,587,570 | 12/1996 | Kelaita, Jr. et al. | 200/50.01 |
| 5,633,619 | 5/1997 | Oetjen et al. | 337/143 |

FOREIGN PATENT DOCUMENTS

| | | | |
|---|---|---|---|
| 3112295 | 10/1982 | Germany | H01H 85/20 |

*Primary Examiner*—Leo P. Picard
*Assistant Examiner*—Anatoly Vortman
*Attorney, Agent, or Firm*—Larry I. Golden; Kareem M. Irfan

[57] ABSTRACT

An interlock assembly is provided for use in a manually operated multi-phase fusible switch having a fuse in series with a blade for each phase and a handle for simultaneously controlling the position of the blades. Each fuse is CONDUCTIVE when it allows current to flow therethrough and is BLOWN when it does not allow current to flow therethrough. The handle is coupled to a drive rod and is movable between an OPEN position and a CLOSED position wherein the blades conduct current therethrough when the handle is in the CLOSED position and do not conduct current therethrough when the handle is in the OPEN position. The interlock assembly includes an interlock mechanism for preventing the handle from being moved from the OPEN position to the CLOSED position when one or more of the fuses are BLOWN or missing, thereby preventing the blade for each phase from moving into the CLOSED position when one or more of the fuses are BLOWN or missing.

15 Claims, 7 Drawing Sheets

INTERLOCK ASSEMBLY FOR A MANUALLY OPERATED MULTI-PHASE FUSIBLE SWITCH

FIELD OF THE INVENTION

This invention relates generally to electrical switching equipment having fuses and, more specifically, to an interlock assembly for preventing closure of the switch if the fuse is BLOWN or missing.

BACKGROUND OF THE INVENTION

The use of Multi-phase fusible switches for connecting three phase power sources to electrical equipment is well known. Commonly, when a fuse is BLOWN, or missing, in one of the phases, it is possible to close the switch and allow electrical current to flow through the other phases that have GOOD fuses therein. If this situation occurs, a single phase condition exists which may damage the electrical equipment that is downstream from the switch. Therefore, in order to prevent a single phase condition, there is a need for providing an interlock assembly for preventing all of the phases in a multi-phase fusible switch to be closed in the event that any one of the fuses are BLOWN or missing.

U.S. patent application Ser. No. 08/461,347 entitled "Interlock Assembly for a Fusible Switch" which is assigned to the same assignee as the present application, shows a three phase switch having an operating mechanism that controls the position of conductive blades. An interlock assembly is included that disables the operating mechanism when one or more of the fuses are BLOWN or missing, thereby preventing the operating mechanism from moving the blades from the OPEN position to the CLOSED position. However, interlocks of this type are only useful for switches that utilize an operating mechanism and are not beneficial for use in manually operated switches that utilize a handle to control the position of the blades.

Accordingly, there is a need to provide an interlock assembly that prevents all phases of a manually operated multi-phase fusible switch from closing in the event that one or more of the fuses are BLOWN or missing.

SUMMARY OF THE INVENTION

It is a general object of the present invention to provide a mechanical interlock assembly for a fusible switch.

It is a more specific object of the present invention to provide an interlock assembly which prevents a switch from being closed when an associated fuse is BLOWN or missing.

In accordance with a preferred embodiment of the present invention an interlock assembly is provided for use in a manually operated multi-phase fusible switch having a fuse in series with a blade for each phase and a handle for simultaneously controlling the position of the blades. Each fuse is CONDUCTIVE when it allows current to flow therethrough and is BLOWN when it does not allow current to flow therethrough. The handle is coupled to a drive rod and is movable between an OPEN position and a CLOSED position wherein the blades conduct current therethrough when the handle is in the CLOSED position and do not conduct current therethrough when the handle is in the OPEN position. The interlock assembly includes an interlock mechanism for preventing the handle from being moved from the OPEN position to the CLOSED position when one or more of the fuses are BLOWN or missing, thereby preventing the blade for each phase from moving into the CLOSED position when one or more of the fuses are BLOWN or missing and preventing the switch from being closed into a single phase condition.

BRIEF DESCRIPTION OF THE DRAWINGS

Other objects and advantages of the invention will be apparent from the following detailed description and the accompanying drawings in which.

DETAILED DESCRIPTION OF THE PREFERRED EMBODIMENTS

For a better understanding of the present invention together with other and further advantages, and capabilities thereof, reference is made to the following disclosure and appended claims in connection with the above-described drawings.

Figure 1:
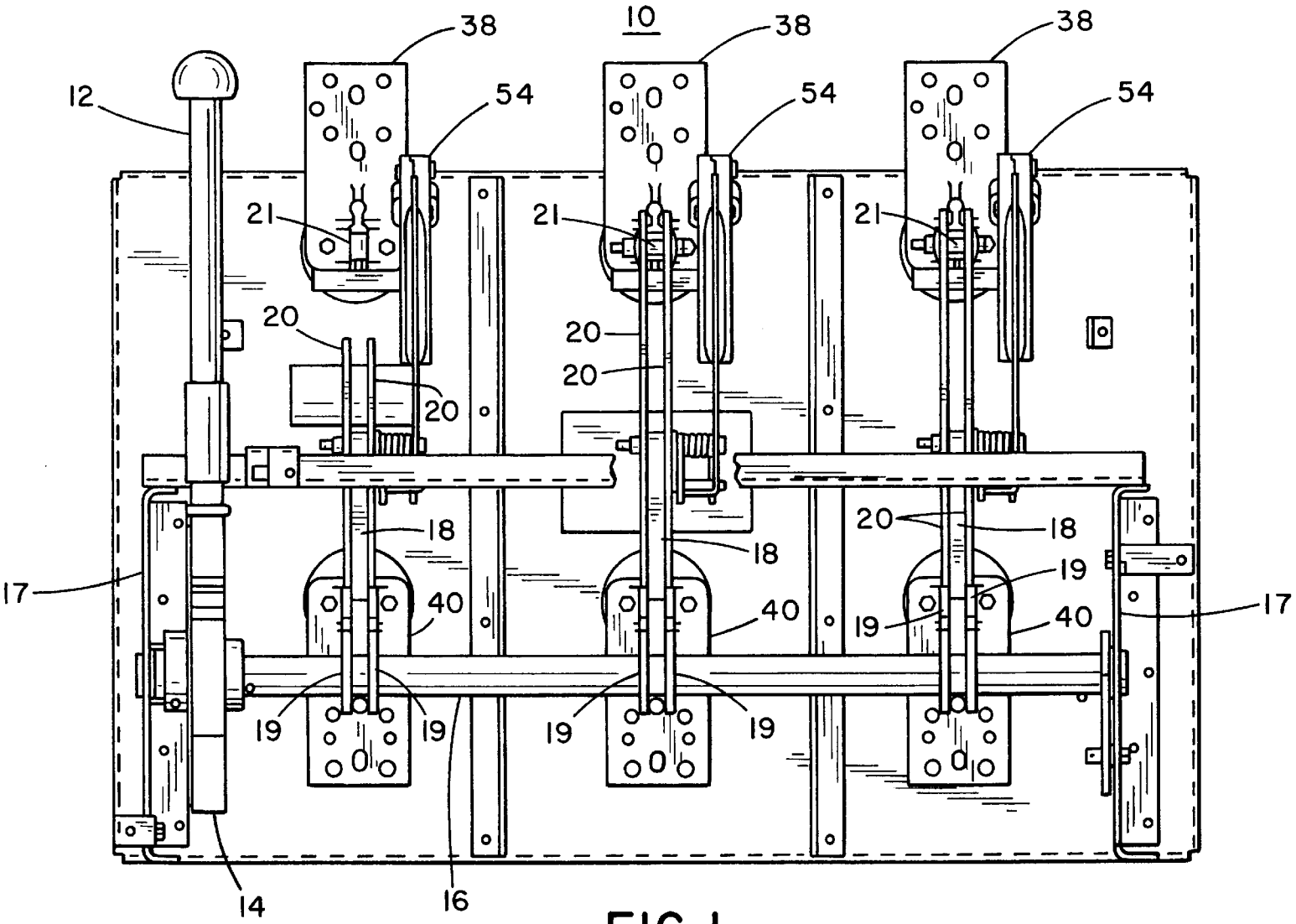
FIG. 1 is a perspective front view of a manually operated three phase fusible switch which can utilize an interlock assembly.

FIG. 1 shows a manually operated three phase switch 10 which includes a handle 12 secured to an operating crank 14. A drive cross bar 16 is coupled to the operating crank 14 and is supported at its ends by a pair of sidewalls 17. Each phase of the switch 10 includes a drive rod 18 coupled at one end to a pair of blades 20 and rotatably coupled at its other end to a pair of drive links 19 which are secured to the drive cross bar 16. The handle 12 is rotatable between an OPEN position and a CLOSED position wherein the blades 20 conduct current therethrough when the handle is in the CLOSED position and do not conduct current when the handle is in the OPEN position. As the handle 12 is rotated, the operating crank 14 causes the drive cross bar 16 to rotate. Rotation of the drive cross bar 16 causes the drive links 19 to rotate about the drive cross bar which causes the drive rod 18 to move each pair of blades 20 into, or out of, contact with a corresponding stationary contact 21.

Figure 2:
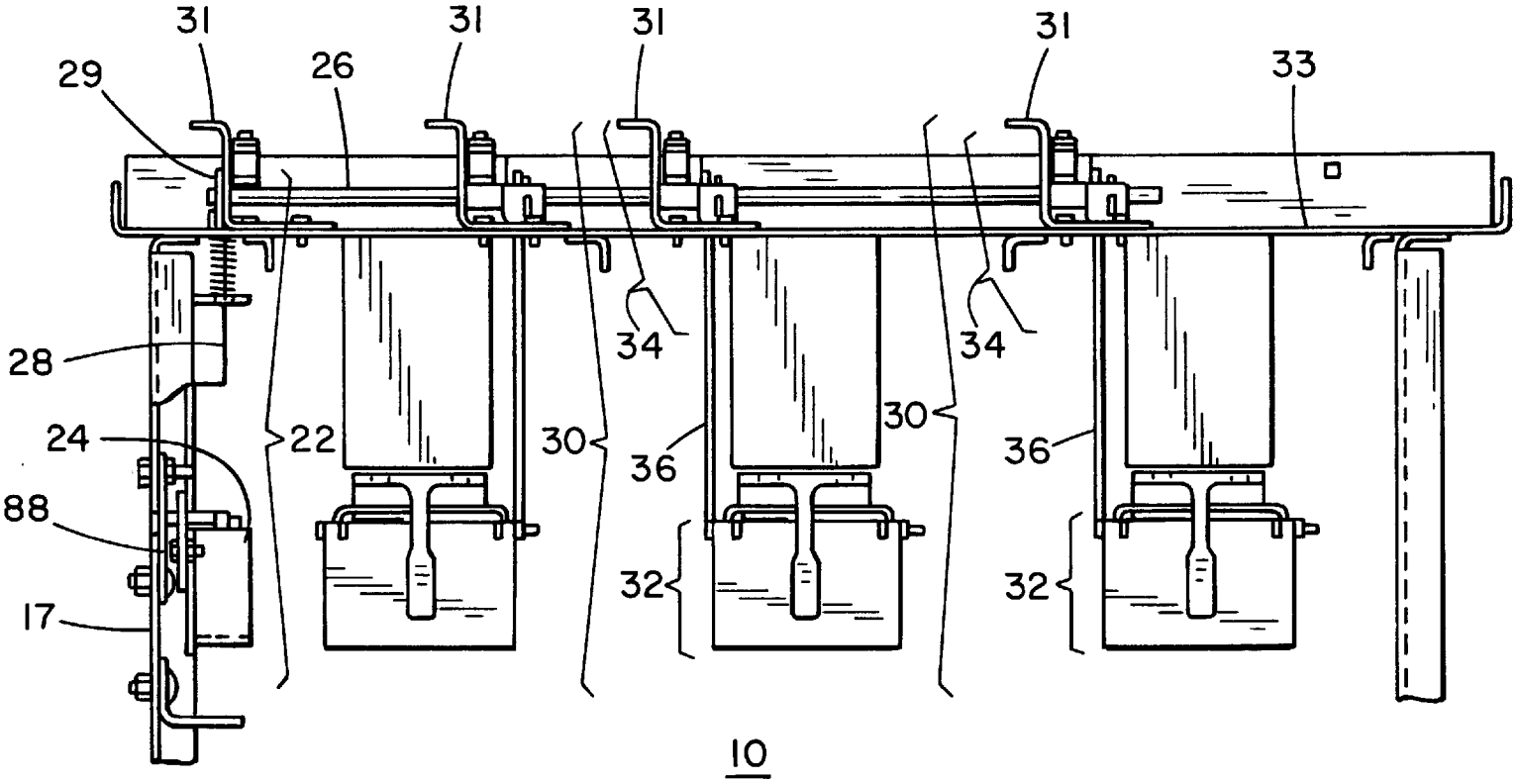
FIG. 2 is a partial perspective top view of a three phase fusible switch which includes an interlock assembly according to the present invention that may be utilized in the three phase fusible switch shown in FIG. 1.

As shown in FIG. 2, the three phase switch 10 includes an interlock assembly 22 in accordance with the preferred embodiment. As shown, the interlock assembly 22 includes an interlock mechanism 24 which is coupled to a rotatable interlock cross bar 26 by an interlock rod 28 and an end lever 29. The interlock cross bar 26 is supported in brackets 31 secured to a back wall 33 of the switch 10. As the interlock cross bar 26 rotates, the end lever 29 translates rotational movement of the cross bar to horizontal movement of the interlock rod 28. Each phase of the switch 10 includes a corresponding fuse interlock assembly 30 which includes an indicator assembly 32 to which an actuator assembly 34 is coupled by a toggle shaft 36. All of the three actuator assemblies 34 are coupled together with the interlock cross bar 26 so that all three phases are in communication with the interlock assembly 22.

Figure 3:
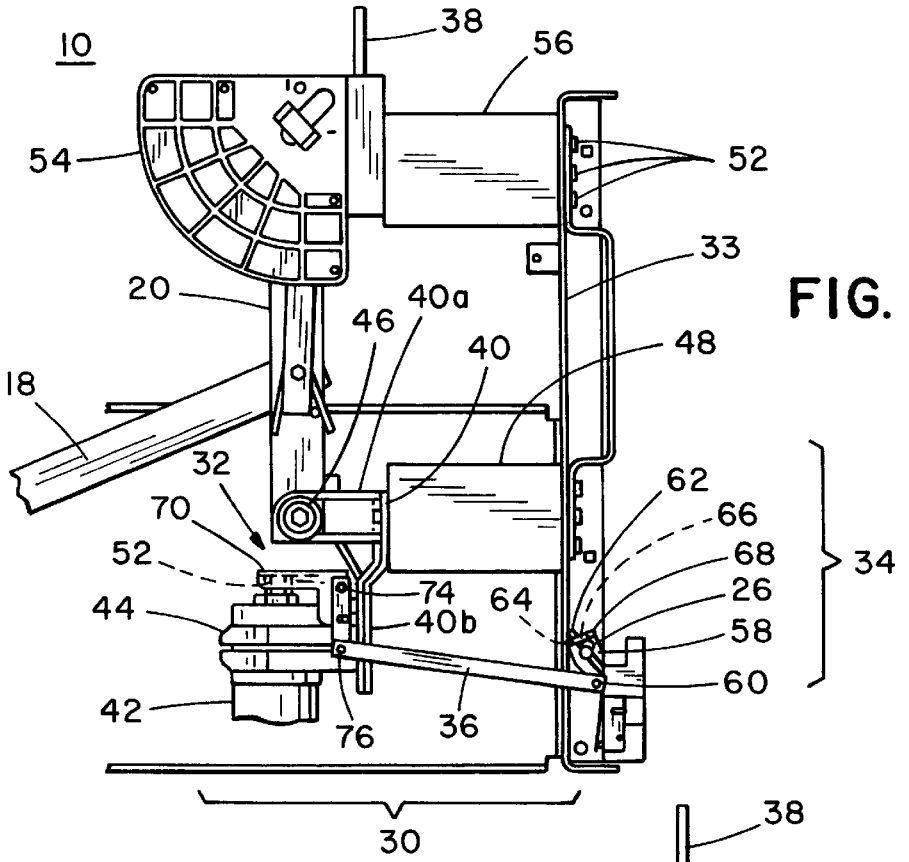
FIG. 3 is a perspective side view of the three phase fusible switch shown in FIG. 2, showing a single phase of the three phase switch with a CONDUCTIVE fuse and a blade in a CLOSED position.
Figure 12:
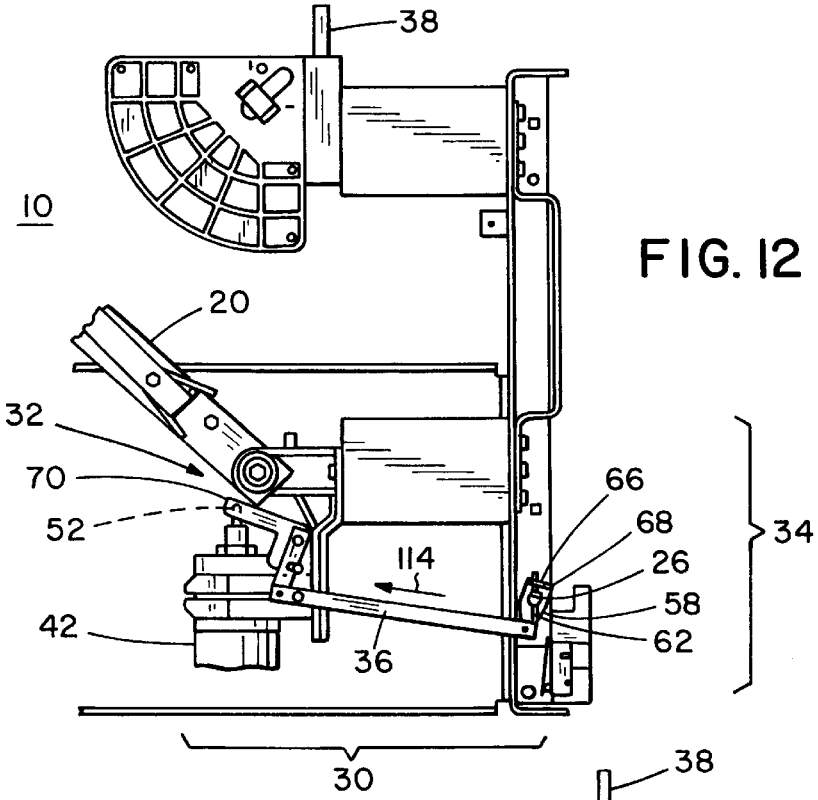
FIG. 12 is a perspective side view of the three phase fusible switch shown in FIG. 1, showing a single phase of the three phase switch with a BLOWN fuse and the blade in an OPEN position.

FIG. 3 shows a side view of a single phase of the switch 10. Each phase of the switch 10 includes the fuse interlock assembly 30 and a current path defined by a line or input terminal 38, stationary contact 21 (shown in FIG. 1), the blades 20, an interconnect terminal 40, a fuse 42 and a load or output terminal (not shown). The fuse 42 is disposed with one end secured in a fuse clip 44 attached to the interconnect terminal 40. The other end of the fuse 42 is secured in a second fuse clip (not shown). The blades 20 are rotatably coupled about a blade pivot 46 at one end and when rotated into a CLOSED position, it is electrically coupling at its other end to the line terminal 38. Thus, current flows through the interconnect terminal 40 when the switch 10 is in the CLOSED position and the fuse 42 is CONDUCTIVE. When the blades 20 are rotated about the pivot 46 into an OPEN position wherein the end of the blades 20 are not electrically coupled to the line terminal 38 (as shown in FIG. 12), current flowing through the current path is interrupted. The blade pivot 46 is secured to a top portion 40*a* of the interconnect terminal 40 and the fuse clip 44 is secured to a bottom portion 40*b* of the interconnect terminal. The interconnect terminal 40 is secured to an insulator 48 which is secured to the back wall 33 of the switch 10. As shown in FIG. 3, the blades 20 and the fuse 42 are placed in series with one another. When either the blades 20 are moved into the OPEN position or the fuse 42 BLOWS, caused by a short circuit or an overload condition, current flow through the switch is interrupted. The fuse 42 has an indicator pin 52 which extends outwardly when the fuse BLOWS thereby indicating the status of the fuse and initiating the actuation of the interlock assembly 22, as will be discussed below.

Each phase of the switch 10 further includes an arc chute 54 which may, for example, be similar to the arc chute described in U.S. Pat. No. 4,362,915 entitled "Electrical Arc Confining Device" which is assigned to the same assignee as the present application and the disclosure therein is incorporated herein by reference. The input terminal 38 and the arc chute 54 are secured to an insulator 56 which is secured to the back wall 33 with a set of bolts 52. Insulators 48 and 56 are made of insulating material to insulate the back wall 33 from the current path.

The fuse interlock assembly 30 is described in more detail in U.S. patent application Ser. No. 08/461,347 entitled "Interlock Assembly for a Fusible Switch" which is assigned to the same assignee as the present application and the disclosure therein is incorporated herein by reference. The fuse interlock assembly 30 will be briefly described hereinbelow.

As shown in FIG. 3, the actuator assembly 34 includes a lever 58 having the interlock cross bar 26 passing therethrough and rotates thereabout. The lever 58 is pivotally coupled to the toggle shaft 36 with a pivot pin 60 at one end. A roll pin 62 extends through the cross bar and cooperates with an edge 64 of a slot 66 in a flange 68 extending from the other end of the lever 58. When the fuse 42 blows, the indicator assembly 32 toggles the toggle shaft 36 in a horizontal direction which causes the lever 58 to rotate around the interlock cross bar 26. As the lever 58 rotates around the interlock cross bar 26 the edge 64 of the slot 66 forces the roll pin 62 to rotate thereby causing the interlock cross bar 26 to rotate.

The interlock cross bar 26 couples the levers of each actuator assembly of each phase of the three phase switch 10 to the shaft (FIG. 2) thereby a BLOWN fuse in any of the phases may prevent the switch 10 from being closed. The slot 66 in the lever 58 serves an important function; when a fuse blows in one phase causing the interlock cross bar 26 and thus the roll pin 62 to rotate, the roll pin traverses in the slot 66 and does not affect the position of the lever 58 in the phases that do not have a BLOWN fuse.

As shown in FIG. 3, the indicator assembly 32 includes an indicator flap 70, a missing fuse flap (not shown), a torsion spring (not shown), and a pivot pin 74. The indicator flap 70 and the missing fuse flap (not shown) are coupled to the pivot pin 74. The pivot pin 74 passes through each side of the indicator flap 70 thereby allowing it to rotate. The torsion spring (not shown) surrounds the pivot pin 74 and has one end engaging a mounting bracket (not shown) and its other end engaging the missing fuse flap (not shown) thereby biasing the missing fuse flap into the fuse 42 in an un-extended position when the fuse is present. When the fuse 42 is missing, the torsion spring biases the missing fuse flap (not shown) outwardly into the area that the fuse would normally be and causing the indicator flap 70 to rotate into an actuated position. The indicator flap 70 is rotatably coupled to the toggle shaft 36 with a pivot pin 76 thereby coupling the indicator assembly 32 to the actuator assembly 34.

Rotational movement of the indicator flap 70 is translated into horizontal movement of the toggle shaft 36. This toggles the actuator assembly 34 and actuates interlock assembly 22 (FIG. 2) to prevent the switch from being closed.

Figure 4:
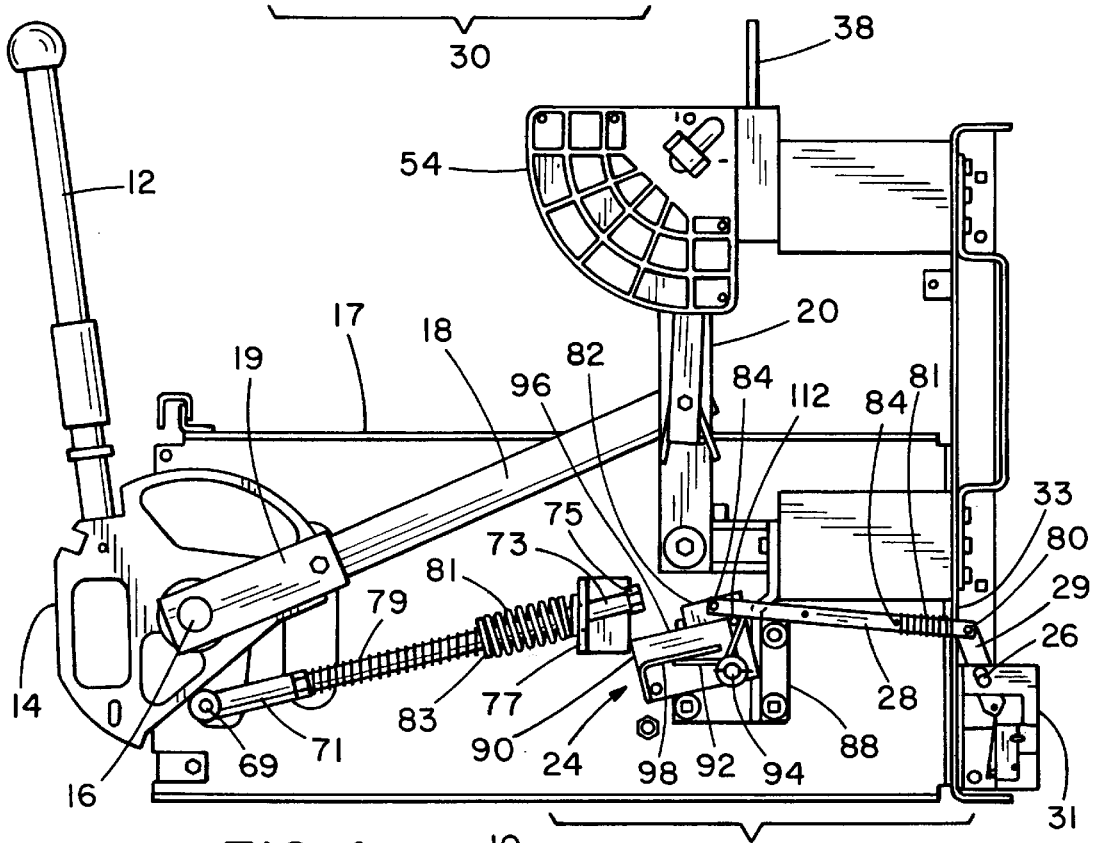
FIG. 4 is a perspective side view of the three phase fusible switch shown in FIG. 2, showing the interlock assembly when the switch has a CONDUCTIVE fuse and the blade is in the CLOSED position.

FIG. 4 shows a turn buckle 71 rotatably coupled the operating crank 14 with a crank pivot pin 69. A push rod 73 is coupled at one end to the turn buckle 71 and has a nut 75 disposed at its other end. The push rod 73 is movable through an aperture in a L-shaped guide bracket 77. A pair of compression springs 79, 81 are disposed around the push rod 73. Each one of the compression springs 79, 81 have a different diameter than the other and are separated by a washer 83.

Figure 5:
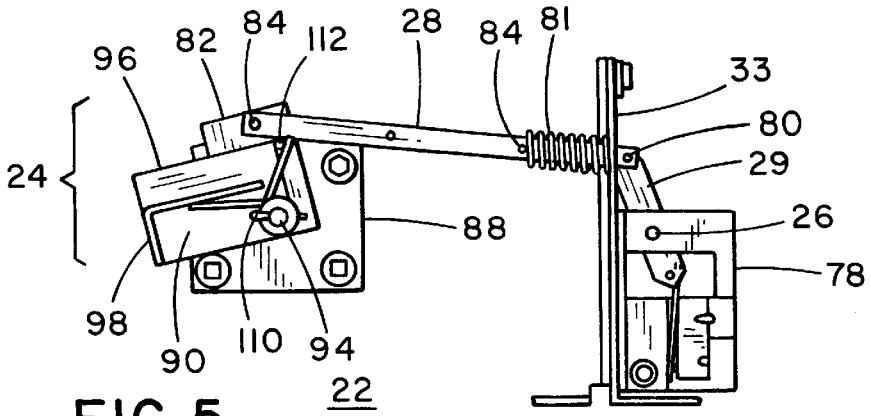
FIG. 5 is a perspective side view of the interlock assembly having an interlock mechanism in accordance with the preferred embodiment of the present invention.

FIGS. 4 and 5 show a side view of the interlock assembly 22 in accordance with the preferred embodiment. As shown, the interlock assembly 22 includes the interlock mechanism 24, interlock rod 28 and end lever 29. The end lever 29 is secured to the interlock cross bar 26 and translates rotational movement of the interlock cross bar 26 to horizontal movement of the interlock rod 28. One end of the end lever 29 is coupled to the interlock rod 28 with a pivot pin 80. A compression spring 81 surrounds one end of the interlock rod 28 and is biased between the end wall 50 and a pin 84. The other end of the interlock rod 28 is coupled to a pivot plate 82 in the interlock assembly 24 with a bolt 84 and nut 86 (shown in FIG. 6).

Figure 6:
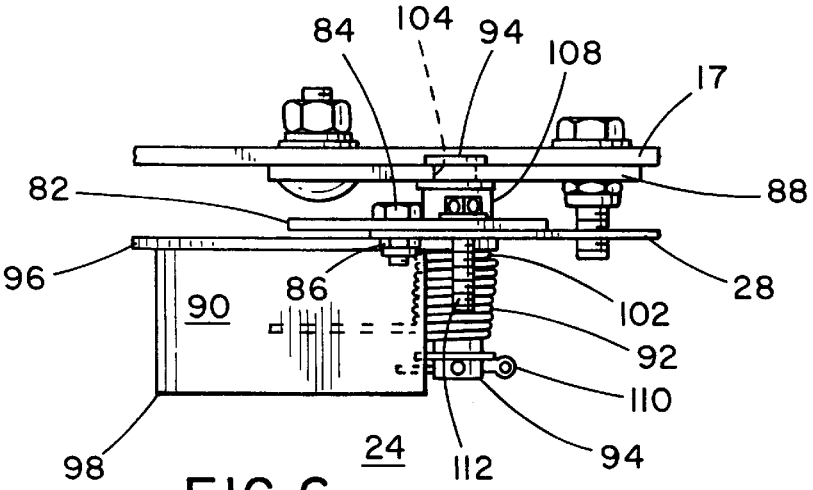
FIG. 6 is a perspective top view of the interlock mechanism shown in FIG. 5.
Figure 7:
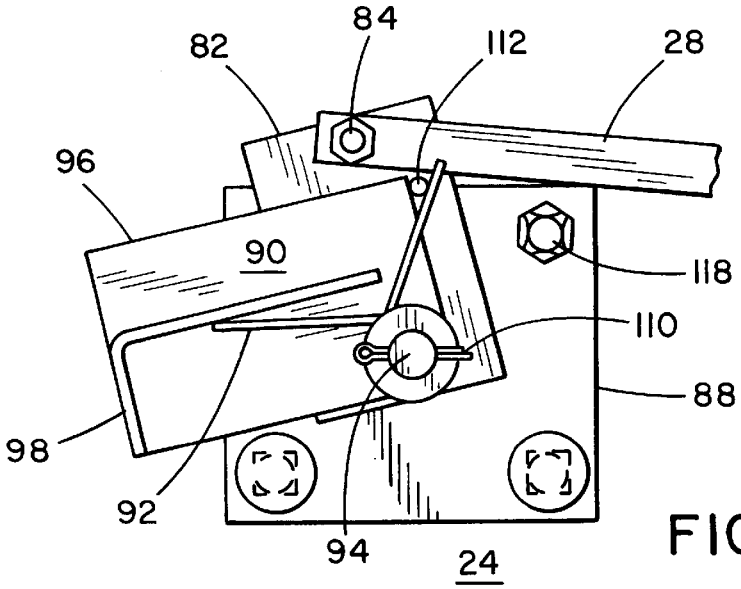
FIG. 7 is a perspective side view of the interlock mechanism shown in FIG. 5 having a blocking assembly and a pivot plate in accordance with the preferred embodiment of the present invention.
Figure 8:
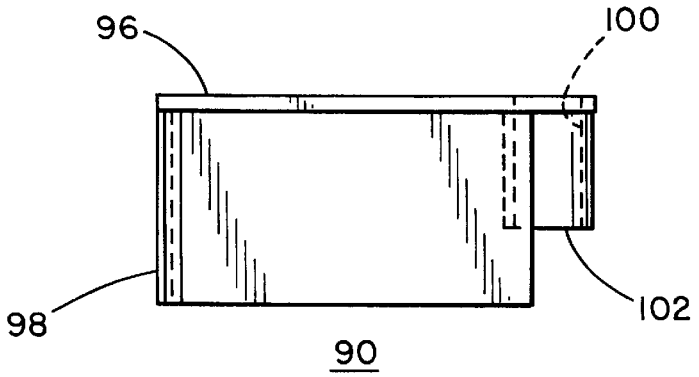
FIG. 8 is a perspective top view of the blocking assembly shown in FIG. 7.
Figure 9:
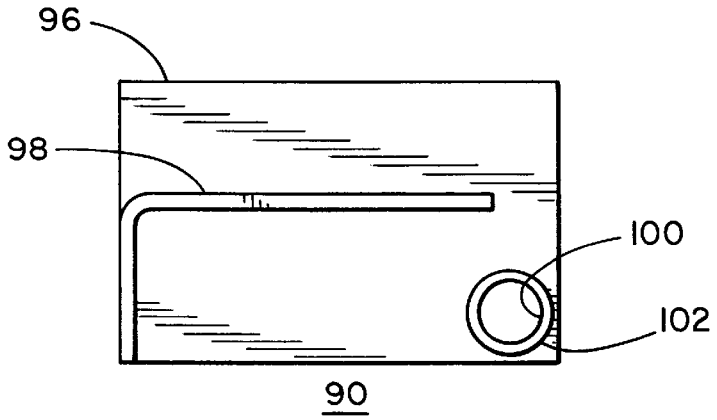
FIG. 9 is a perspective side view of the blocking assembly shown in FIG. 7.
Figure 10:
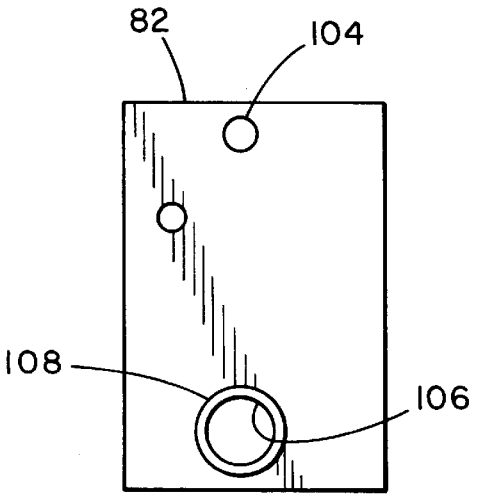
FIG. 10 is a perspective side view of the pivot plate shown in FIG. 7.
Figure 11:
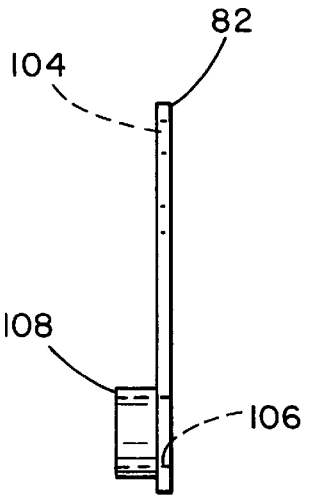
FIG. 11 is a perspective front view of the pivot plate shown in FIG. 7.

FIGS. 6 and 7 show the interlock mechanism 24 includes a mounting plate 88, a blocking assembly 90, a torsion spring 92, a mounting pin 94 and the pivot plate 82. The mounting plate 88 is secured to the sidewall 17 with conventional bolts and nuts. FIGS. 8 and 9 show the blocking assembly includes a rear plate 96 having a L-shaped blocking plate 98 secured thereto, an aperture 100 therein and a sleeve 102 extending therefrom. FIGS. 10 and 11 show the pivot plate 82 having an aperture 104 for allowing the pin 84 (FIG. 6) to pass therethrough. The pivot plate 82 has a mounting pin aperture 106 therein and a mounting pin sleeve 108 extending therefrom for allowing the mounting pin 94 (FIG. 6) to pass therethrough.

As shown in FIG. 6, the mounting pin sleeve 108 provides for separation between the mounting plate 88 and the pivot plate 82. The mounting pin 94 is secured in an aperture 104 in the mounting plate 88 and passes through the aperture 104 and mounting pin sleeve 108 of the pivot plate 82. The mounting pin also passes through the aperture 100 and the sleeve 102 of the rear plate 96 to provide for a rotational pivot for the pivot plate 82 and the blocking assembly 90. The torsion spring 92 is disposed around the mounting pin 94 and the sleeve 102. The interlock assembly 24 is secured together with a securing means, such as a cutter pin 110 disposed in an aperture in one end of the mounting pin 94. As shown in FIG. 7, the torsion spring 92 has one leg biased onto the blocking plate 98 and its other leg biased against a stop pin 112.

The operation of the interlock assembly 22 will now be discussed. FIG. 3 shows the blades 20 in the CLOSED position and the fuse 42 CONDUCTIVE. As shown in FIG. 12, when the fuse 42 detects an overcurrent or a short circuit condition, it will BLOW causing the extender pin 52 to extend outwardly forcing the indicator flap 70 to rotate clockwise. The clockwise rotation of the indicator flap 70 pulls the toggle shaft 36 horizontally in the direction of direction arrow 114 causing the lever 58 to rotate clockwise. As the lever 58 rotates clockwise the roll pin 62 engages an end of the slot 66 thereby causing the interlock cross bar 26 to rotate clockwise. The clockwise rotation of the interlock cross bar 26 causes the end lever 29 (shown in FIG. 4) to rotate clockwise.

Figure 13:
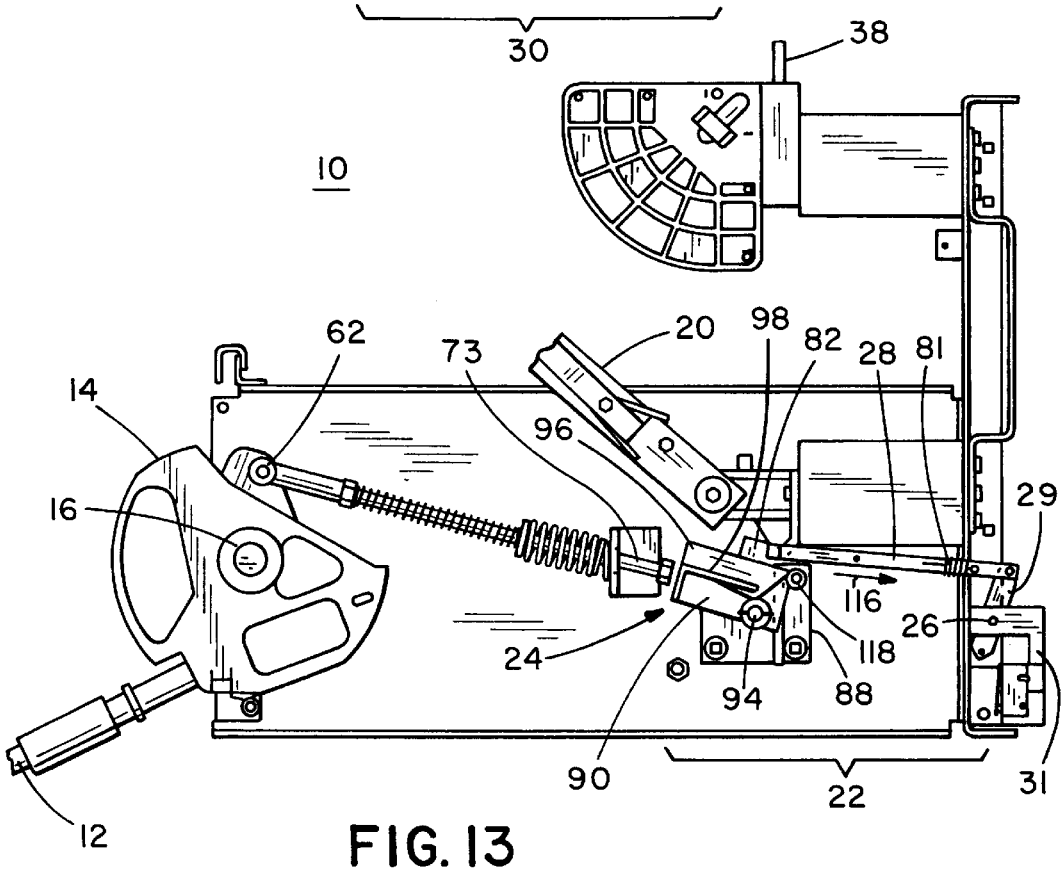
FIG. 13 is a perspective side view of the three phase fusible switch shown in FIG. 2, showing the interlock assembly when the fuse is BLOWN or missing and the blade is in an OPEN position.

As shown in FIG. 13, the clockwise rotation of the end lever 29 causes the interlock rod 28 to translate in the direction of direction allow 116 compressing the spring 81 and causing blocking assembly 90 to rotate clockwise about the mounting pin 94 until the rear plate 96 engages a stop bolt 118. With the blocking assembly in this position, the blades 20 may move to the OPEN position; however, they may not move back into the CLOSE position until the fuse 42 is replaced with a good fuse.

Until the BLOWN fuse is replaced with a good or CONDUCTIVE fuse, which has its extender pin 52 recessed therein, the blades 20 are prevented from being moved into the CLOSED position because the extender pin 52 holds the fuse interlock assembly 30 in the actuated position shown in FIG. 12. With the extender pin 52 extended, the indicator flap 70 remains rotated clockwise which holds the toggle shaft 36 in the toggled position thereby holding the lever 66 in the clockwise position. With the lever 66 in the clockwise position, the cross bar remains rotated clockwise which holds the end lever 29 in the clockwise position. With the end lever 29 in the clockwise position, the interlock rod 28 is held in the position shown in FIG. 13, thereby holding the blocking assembly 90 in the blocking position shown in FIG. 13. With the blocking assembly in the blocking position, the blades of each phase may be moved to the OPEN position; however, the blocking plate 98 prevents the push rod 73 from moving forward, which prevents the operating crank 14 from rotating clockwise, thereby preventing the blades of each phase from being moved into the CLOSED position.

Figure 14:
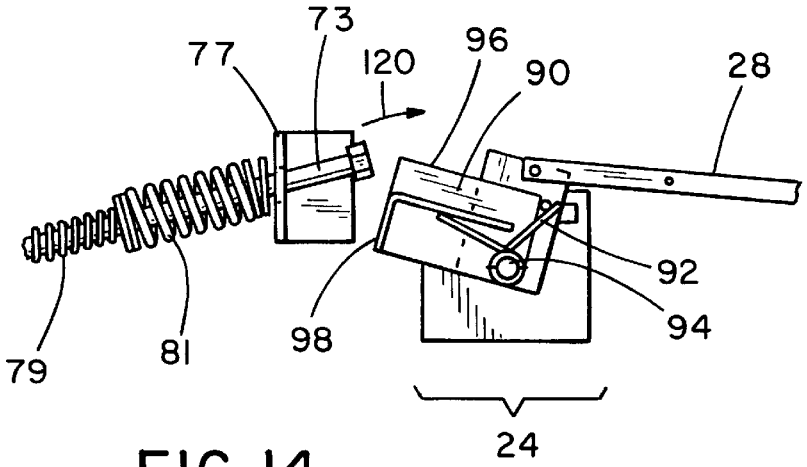
FIG. 14 is a perspective side view of the interlock assembly and a drive rod when the fuse is BLOWN or missing and the handle of the three phase fusible switch is in a CLOSED position.
Figure 15:
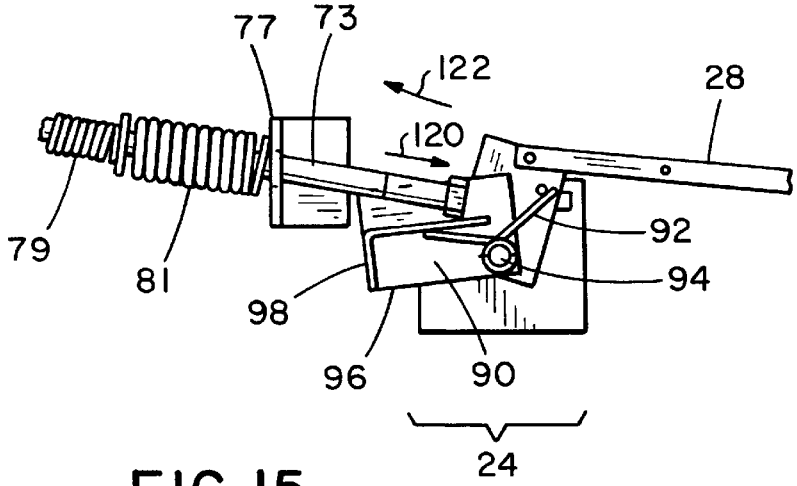
FIG. 15 is a perspective side view of the interlock assembly and the drive rod when the fuse is BLOWN or missing and the handle is between the CLOSED position and an OPEN position.

FIG. 14 shows the position of the push rod 73 when the handle 12 (FIG. 4) is in the CLOSED position and also shows the blocking assembly 90 in the engaged position. To move the handle 12 from the CLOSED position (as shown in FIG. 4) to the OPEN position (as shown in FIG. 13), the handle is pulled downward. This downward movement of the handle 12 (FIG. 4) causes the operating crank 14 (FIG. 4) to rotate counterclockwise about the drive cross bar 16 (FIG. 4) which causes the push rod 73 to move laterally in the direction of direction arrow 120. As shown in FIG. 15, as the drive rod 73 continues to move in the direction of the direction arrow 120, the drive rod 73 rotates in a clockwise direction through the guide bracket 77. This lateral and rotational movement of the drive rod 73 forces it to engage a top portion of the blocking plate 98 and forces the blocking assembly 90 to rotate counterclockwise about mounting pin 94. This counterclockwise rotation of the blocking assembly 90 extends the legs of the torsion spring 92 between the stop pin 112 and the blocking plate 98. As the operating crank 14 (FIG. 4) continues to rotate counterclockwise, the drive rod 73 continues to move in the direction of the direction arrow 120 until the crank pivot pin 69 (FIG. 4) passes a mid point where the operating crank 14 begins to pull the drive rod 73 in the direction of direction arrow 122. As the drive rod 73 moves in the direction of the direction arrow 122, it disengages the blocking plate 98 which then allows the torsion spring 92 to rotate the blocking plate clockwise into the engaged position shown in FIGS. 14 and 16.

Figure 16:
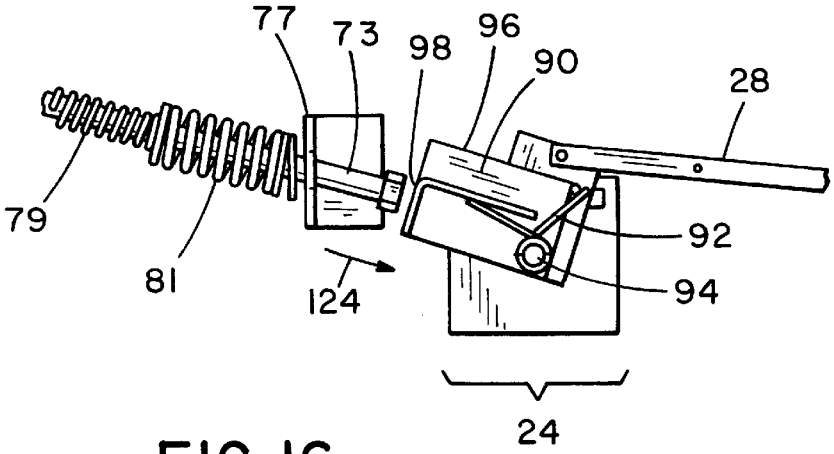
FIG. 16 is a perspective side view of the interlock assembly and the drive rod when the fuse is BLOWN or missing and the handle is in the OPEN position.

FIG. 16 shows the drive rod 73 when the handle 12 is in the OPEN position (as shown in FIG. 13) and the blocking assembly 90 in the engaged position. When the fuse 42 (FIG. 12) is BLOWN or missing the blocking assembly 90 is in this engaged position. If the handle (FIG. 12) were attempted to be pushed into the CLOSED position, the operating crank 14 (FIG. 13) would rotate clockwise forcing the drive rod 73 to move in the direction of direction arrow 124 until the drive rod engages the blocking plate 98. When the drive rod 73 engages the blocking plate 98, the drive rod is blocked, or prevented, from continuing to move in the direction of direction allow 124, thereby preventing the handle 12 (FIG. 13) and the blades of each phase from moving into the CLOSED position.

When a good fuse is installed in the switch 10, the fuse interlock assembly 30 returns to the position shown in FIG.

3 and the interlock assembly 22 is then allowed to return to the disengaged position shown in FIG. 4, thereby allowing the handle 12 and the blades of each phase be moved to the CLOSED position.

The blades 20 are also prevented from being moved into the CLOSED position when the fuse is not present. As described in U.S. patent application Ser. No. 08/461,347 the torsion spring (not shown) biases the missing fuse flap (not shown) outwardly in the clockwise direction and into the area where the fuse would normally be located. The clockwise rotation of the missing fuse flap causes the indicator flap 70 to rotate clockwise into the actuated position thereby holding the trip lever 68 in the position shown in FIG. 12 which causes the interlock cross bar 26 to be rotated clockwise. With the interlock cross bar 26 rotated clockwise, the end lever 29 is in the position shown in FIG. 13 and the blades 20 are prevented from being CLOSED, as previously described.

An exemplary fuse that may be used for the fuse 42 is available as part no. A055F-1DSR0-200E from Square D Company of Palatine, Ill. The extender pin 52 is an integral part of the fuse and extends outwardly when the fuse blows caused by a short circuit or overcurrent condition in the circuit it is protecting.

While there have been shown and described what are at present considered the preferred embodiments of the invention, it will be obvious to those skilled in the art that various changes and modifications may be made therein without departing from the scope of the invention as defined by the appended claims.

What is claimed is:

1. An interlock assembly for a manually operated multi-phase switch having a fuse in series with a blade for each phase and a handle for simultaneously controlling the position of the blades, each fuse is CONDUCTIVE when it allows current to flow therethrough and is BLOWN when it does not allow current to flow therethrough, the handle is coupled to a drive rod and is movable between an OPEN position and a CLOSED position wherein the blades conduct current therethrough when the handle is in the CLOSED position and do not conduct current therethrough when the handle is in the OPEN position, the interlock assembly includes an interlock mechanism for preventing the handle from being moved from the OPEN position to the CLOSED position when one or more of the fuses are BLOWN or missing, thereby preventing the blade for each phase from moving into the CLOSED position when one or more of the fuses are BLOWN or missing, the interlock mechanism having a torsion spring and a blocking member rotatable between a first position and a second position, wherein the handle is allowed to move from the OPEN position to the CLOSED position when the blocking member is in the first position and the handle is not allowed to move from the OPEN position to the CLOSED position when the blocking member is in the second position the torsion spring biasing the blocking member to the second position when the handle is in the OPEN position.

2. An interlock assembly according to claim 1, wherein the drive rod engages the blocking member when the blocking member is in the second position and the handle is attempted to be moved from the OPEN position to the CLOSED position, thereby preventing the handle from moving from the OPEN position to the CLOSED position when one or more of the fuses are BLOWN or missing.

3. An interlock assembly according to claim 1, wherein the interlock mechanism allows the handle to be moved from the CLOSED position to the OPEN position when one or more of the fuses are BLOWN.

4. An interlock assembly according to claim 1, further including a toggle member coupled to the interlock mechanism for communicating the status of the fuses to the interlock mechanism, wherein the toggle member is in one position when all of the fuses are CONDUCTIVE and the toggle member is in another position when one or more of the fuses are BLOWN.

5. A manually operated multi-phase fusible switch comprising:

a current path for each phase which includes a blade and a fuse wherein the fuse is electrically coupled in series with the blade;

a handle coupled to each blade for simultaneously moving the blades between an OPEN position and a CLOSED position, wherein the blades conduct current therethrough when they are in the CLOSED position and do not conduct current therethrough when the are in the OPEN position; and an interlock assembly having an interlock mechanism for preventing the handle from moving the blades from the OPEN position to the CLOSED position when one or more of the fuses are BLOWN or missing, the interlock assembly having a rod coupled to the interlock mechanism for communicating the status of the fuse to the interlock mechanism, wherein the rod is in one position when the fuse is CONDUCTIVE and the rod is in another position when the fuse is BLOWN, the interlock mechanism having a pivot plate, a blocking member and a torsion spring, the pivot plate rotatably coupled to the rod the blocking member rotatably coupled to the pivot plate for interfering with movement of the handle when one or more of the fuses are BLOWN and the torsion spring biasing the blocking member.

6. A switch according to claim 5, further including a first lever connected to the cross bar and to the rod, wherein the lever transfer rotational movement of the cross bar to horizontal movement of the rod.

7. A switch according to claim 5, wherein the interlock assembly further prohibits the blades from being moved from the OPEN position to the CLOSED position when one or more of the fuses are absent.

8. A switch according to claim 5, further including an indicator assembly disposed adjacent to each fuse for indicating the status of the fuse and actuating the interlock assembly to prevent the blades from being moved from the OPEN position to the CLOSED position when one or more of the fuses are BLOWN.

9. A fusible switch comprising:

a blade capable of conducting current and movable between a CLOSED position and an OPEN position, wherein the blade conducts current therethrough when it is in the CLOSED position and does not conduct current when it is in the OPEN position;

a fuse electrically coupled in series with the blade and including an extender member therein which extends outwardly when the fuse is BLOWN due to an overload condition or a shout circuit condition;

an indicating means for indicating the status of the fuse;

a handle coupled to the blade for moving the blade between an OPEN position wherein the blade does not conduct current therethrough and a CLOSED position wherein the blade conducts current therethrough; and an interlock assembly having an interlock mechanism coupled to the indicating means for prohibiting the handle from being moved from the OPEN position to the CLOSED position when the extender member is extending outwardly from the fuse, thereby preventing the blade from being moved from the OPEN position to the CLOSED position when the fuse is BLOWN, the interlock mechanism having a pivot plate a blocking member and a torsion spring, the pivot plate rotatable coupled to the rod, the blocking member rotatably coupled to the pivot plate for interfering with movement of the handle when one or more of the fuses are BLOWN, and the torsion spring biasing the blocking member.

10. A switch according to claim 9, further including a cross bar coupled to the indicating means and to the interlock assembly for mechanically communicating the status of the fuse to the interlock assembly from the indicating means wherein the cross bar is in one position when the fuse is conductive and the cross bar is in another position when the fuse is BLOWN.

11. A switch according to claim 10, wherein the interlock assembly further includes a rod coupled to the cross bar at one of its ends and coupled to the interlock mechanism at its other end, the rod mechanically communicating the position of the cross bar to the interlock mechanism wherein the rod is in position when the fuse is conductive and is in another position when the fuse is BLOWN.

12. A switch according to claim 11, further including a first lever connected to the cross bar and to the rod, wherein the lever transfer rotational movement of the cross bar to horizontal movement of the rod.

13. A fusible switch according to claim 12, wherein the indicating means includes:

an indicator member disposed adjacent to the fuse for indicating the status of the fuse;

an actuator member coupled to the cross bar; and a toggle member coupled to the indicator member and to the actuator member for mechanically communicating the status of the fuse to the actuator member form the indicator member wherein the toggle member is in one position when the fuse is conductive and the toggle member is in another position when the fuse is BLOWN.

14. A fusible switch according to claim 13, further including a second lever coupled to the actuator member and to the cross bar for interfacing the toggle member to the cross bar.

15. A switch according to claim 9, wherein the interlock assembly further prohibits the handle from being moved from the OPEN position to the CLOSED position when the fuse is absent.

* * * * *